US008410707B2

(12) United States Patent
Teng et al.

(10) Patent No.: US 8,410,707 B2
(45) Date of Patent: Apr. 2, 2013

(54) DUTY CYCLE ADJUSTING CIRCUIT OF A LIGHTING SYSTEM AND METHOD THEREOF

(75) Inventors: Chia-Shen Teng, Hsinchu (TW); Tze-Ching Tung, Taipei (TW); Chun-Ming Chuang, Hsinchu (TW)

(73) Assignee: UPEC Electronics Corp., Taipei (TW)

( * ) Notice: Subject to any disclaimer, the term of this patent is extended or adjusted under 35 U.S.C. 154(b) by 180 days.

(21) Appl. No.: 12/896,459

(22) Filed: Oct. 1, 2010

(65) Prior Publication Data

US 2011/0080099 A1 Apr. 7, 2011

(30) Foreign Application Priority Data

Oct. 1, 2009 (TW) ..... 98133454 A

(51) Int. Cl.
*H05B 37/02* (2006.01)

(52) U.S. Cl. ..... 315/152; 315/150; 315/291; 315/294; 315/297; 315/312

(58) Field of Classification Search ..... 315/209 R, 315/152, 291, 294, 297, 360
See application file for complete search history.

(56) References Cited

U.S. PATENT DOCUMENTS

| | | | | |
|---|---|---|---|---|
| 7,397,205 | B2 | 7/2008 | Huang et al. | |
| 2008/0315800 | A1* | 12/2008 | Huang et al. | 315/360 |
| 2011/0084615 | A1* | 4/2011 | Welten | 315/152 |
| 2011/0156596 | A1* | 6/2011 | Salsbury | 315/152 |

* cited by examiner

*Primary Examiner* — Douglas W Owens
*Assistant Examiner* — Jonathan Cooper
(74) *Attorney, Agent, or Firm* — Baker & McKenzie LLP

(57) ABSTRACT

The present disclosure relates to a duty cycle adjusting circuit of a lighting system and method thereof for sensing light of a first color and a second color emitted by a light emitting device of the first color and a light emitting device of the second color to generate corresponding intensity values. Then a first pulse width correcting value and a second pulse width correcting value can be calculated for adjusting a first duty cycle and a second duty cycle of a driving current to adjust the illuminating intensity of the light emitting devices of the first and the second colors. Through these adjusting steps, the light of the first and the second colors is within a predetermined range of color temperature. Therefore, light source for stable light in color temperature is provided.

8 Claims, 3 Drawing Sheets

DUTY CYCLE ADJUSTING CIRCUIT OF A LIGHTING SYSTEM AND METHOD THEREOF

RELATED APPLICATION

The present application claims priority under 35 U.S.C. 119(a) to Taiwan application number 098133454 filed on Oct. 1, 2009, which is incorporated herein by reference in its entirety as if set forth in full.

FIELD OF THE INVENTION

This invention relates to a duty cycle adjusting circuit of a lighting system and method thereof, and more particularly to a duty cycle adjusting circuit of a lighting system and method thereof regarding intensity and signals for colors.

DESCRIPTION OF THE RELATED ART

Light Emitting Diode (LED) is a cold light source which shows several great characteristics in power saving, device consumption, trigger time, mercury content and lifetime. Since the breakthrough for blue LED had been presented to the modern technology in late twentieth century, LEDs of various colors that emit light with high intensity are broadly applied in displays, projectors, lighting apparatus, etc. Now, though the LED is the light source to draw everyone's attention, the LEDs inevitable nature, light of single hue an individual LED chip can emit, forces the manufactures of the LED products to integrate several LEDs which emit light of different hues to a lighting module to provide a colorful light source.

Generally, LEDs emit light of red, blue and green colors are combined to mix for white light. The conducting time and intensity of these LEDs of red, blue and green colors are controlled respectively, but such controlling mechanism is designed only for typical circumstances, and is unable to fix the worn stability of the intensity or color temperature harmed by high temperature or natural aging after used for a long time. One solution is to add a detecting and feedback mechanism in controlling circuit to provide feedback signals to the driving device of the LEDs of three colors, respectively, according to the sensed intensity of the LEDs. The illuminating intensity should be adaptively adjusted on a real-time basis, however, such mechanism requires numerous light sensors and also make the adjusting circuit complicated, both of which increase the cost. Meanwhile, new problems may occur, such as the limited duty cycle and decreased lighting efficiency, the system disclosed in U.S. Pat. No. 7,397,205 faces, which corrects intensity with current value.

An efficient adjusting circuit that will not induce more problems is desirable.

SUMMARY

An aspect of the present invention is to respectively adjust the duty cycle to emit light of light emitting device of a first color and light emitting device of a second color, and then illuminating intensity of the at least one light emitting device of the first color and at least one light emitting device of the second color is also adjusted.

Another aspect of the present invention is to adjust the duty cycle of the driving currents which drives the light emitting device of the first color and light emitting device of the second color to emit light respectively, and make the light within a predetermined range of color temperature to provide a stable light source with stable color temperature.

Another aspect of the present invention is to apply a sensing unit for sensing light of various colors for adjusting the intensity values to simplified circuit complexity.

According to one aspect of the present invention, a duty cycle adjusting circuit of a lighting system is provided for adjusting illuminating intensity of at least one light emitting device of a first color and at least one light emitting device of a second color according to a plurality of intensity values respectively, comprising: a driving unit, producing a first driving current and a second driving current wherein the first driving current comprises a first duty cycle, the second driving current comprises a second duty cycle, the driving unit drives the light emitting device of the first color to emit light of the first color in the first duty cycle, and the second duty cycle drives the light emitting device of the second color to emit light of the second color; a sensing unit, respectively sensing the light of the first color and the light of the second color to produce the intensity values correspondingly; a controlling unit, calculating a first pulse width correcting value and a second pulse width correcting value according to the intensity values, wherein the first pulse width correcting value corresponds to the light emitting device of the first color, the second pulse width correcting value corresponds to the light emitting device of the second color; and a pulse width adjusting unit, adjusting the first duty cycle and the second duty cycle according to the first pulse width correcting value and the second pulse width correcting value, respectively.

According to the present invention, a duty cycle adjusting method is provided for adjusting illuminating intensity of at least one light emitting device of a first color and at least one light emitting device of a second color according to a plurality of intensity values respectively, comprising the steps of: (A) generating a first driving current and a second driving current, wherein the first driving current comprises a first duty cycle and the second driving current comprises a second duty cycle; (B) driving the light emitting device of the first color to emit light of the first color in the first duty cycle and the light emitting device of the second color to emit light of the second color in the second duty cycle; (C) respectively sensing the light of the first color and the light of the second color to generate the intensity values correspondingly; (D) calculating a first pulse width correcting value and a second pulse width correcting value according to the intensity values, wherein the first pulse width correcting value corresponds to the light emitting device of the first color, and the second pulse width correcting value corresponds to the light emitting device of the second color; and (E) adjusting the first duty cycle and the second duty cycle according to the first pulse width correcting value and the second pulse width correcting value, respectively.

Therefore, after sensing the light of the first and second colors, the corresponding intensity values are generated for calculating the first pulse width correcting value and the second pulse width correcting value which forms the basis to adjust the first and second duty cycles to adjust the illuminating intensity of the light emitting devices of the first and second colors, respectively. Preferably, by the above-mentioned adjustment, the color temperature of the light of the first and second color is within in a predetermined range of color temperature, set or predetermined by users or manufacturers, to provide a stable light source with a stable color temperature. Additionally, in the first duty cycle and second duty cycle, the light emitting device of the first color and the light emitting device of the second color are driven respectively to conduct a predetermined current. Preferably the first duty cycle or second duty cycle is adjusted increasingly to increase the duty cycles of the light emitting device of the first color or light emitting device of the second color, and in the best mode, the duty cycles of the light emitting device of the first color or light emitting device of the second color are increased up to 60% or above.

BRIEF DESCRIPTION OF THE DRAWINGS

The accompanying drawings are included to provide a further understanding of the present invention, and are incorporated in and constitute a part of this description. The drawings illustrate embodiments of the present invention, and together with the description, serve to explain the principles of the present invention. There is shown.

DESCRIPTION OF THE PREFERRED EMBODIMENTS

In the following description, numerous details are set forth in order to provide a thorough understanding of the present invention with reference to drawings which are not drawn in an exact ratio. It will be appreciated by one skilled in the art that variations of these specific details are possible while still achieving the results of the present invention. In other instances, well-known backgrounds are not described in detail in order not to unnecessarily obscure the present invention.

Figure 1:
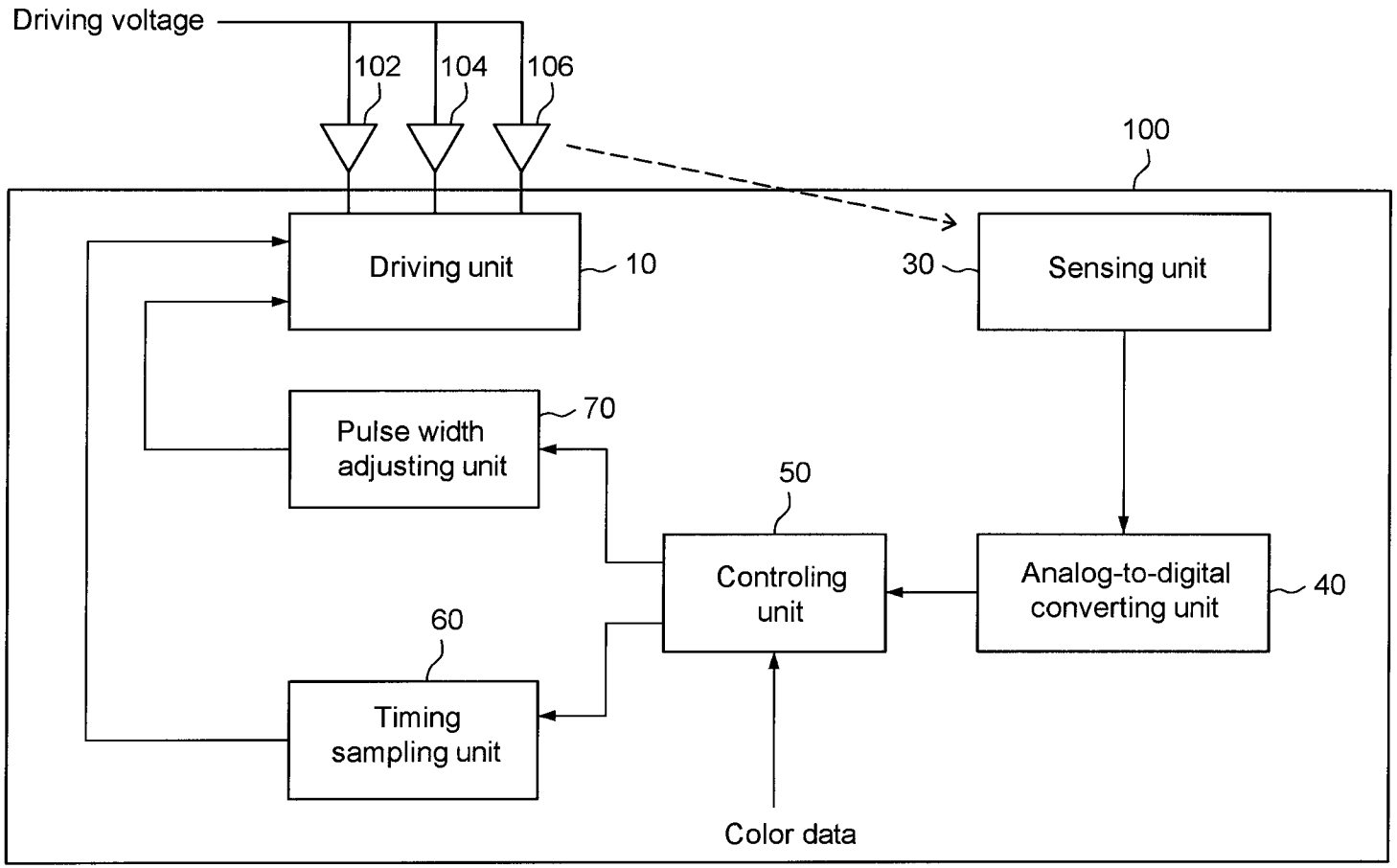
FIG. 1 illustrates a block diagram of a duty cycle adjusting circuit of a lighting system in an embodiment according to one aspect of the present invention.

Please refer to FIG. 1 which shows a block diagram of a duty cycle adjusting circuit of a lighting system in an embodiment according to one aspect of the present invention. As shown, the duty cycle adjusting circuit 100 comprises a driving unit 10, a sensing unit 30, an analog-to-digital converting unit 40, a controlling unit 50, a timing sampling unit 60, and a pulse width adjusting unit 70. In the present embodiment, the duty cycle adjusting circuit 100 optionally comprises a storing unit 20, an analog-to-digital converting unit 40 and a timing sampling unit 60, however in other embodiments according to the present invention, the analog-to-digital converting unit 40 and/or timing sampling unit 60 may be omitted or replaced by different numbers of other elements. The duty cycle adjusting circuit 100 may adjust illuminating intensity of at least one light emitting device of a first color and at least one light emitting device of a second color according to a plurality of intensity values respectively. In the present embodiment, the light emitting devices of the first and second colors may be implemented with LEDs of three different colors, such as red LED 102, green LED 104 and blue LED 106. Through the driving unit 10, the duty cycle adjusting circuit 100 electrically connects to the red LED 102, green LED 104 and blue LED 106 respectively. Between the sensing unit 30 and the controlling unit 50, the analog-to-digital converting unit 40 is electrically connected. The controlling unit 50 electrically connects to the timing sampling unit 60 and the pulse width adjusting unit 70 respectively. The output ends of the timing sampling unit 60 and the pulse width adjusting unit 70 electrically connect to the driving unit 10.

When the duty cycle adjusting circuit 100 is activated, the controlling unit 50 may control the timing sampling unit 60 or the pulse width adjusting unit 70 according to a plurality of intensity reference values and a plurality of reference timings. These intensity reference values and reference timings may be set or predetermined by users or manufacturers, storing in a storing unit electrically connecting to the controlling unit 50. The intensity reference values can be set or predetermined according to the electrical characters of the light emitting devices applied in the present embodiment or the standard regarding to the color temperature the users or manufacturers used for the duty cycle adjusting circuit 100. For example, in the present embodiment, the intensity reference values may correspond to the intensity of the red LED 102, green LED 104 and blue LED 106 respectively when the duty cycle adjusting circuit 100 emits light which is within in a predetermined range of color temperature, such as 8500K±20%. The following paragraphs will illustrate subsequent flows after providing the intensity reference values to the controlling unit 50.

After the timing sampling unit 60 gets the reference timings, it will generate a plurality of driving timings and a plurality of sampling timings to be provided to the driving unit 10 for generating a plurality of driving currents. These driving currents comprises a duty cycle (Duty Cycle) respectively. When in the duty cycle, if a driving voltage which is higher than the conducting voltage of the light emitting devices, the light emitting devices will conduct and emit light. Preferably, when the driving unit 10 is in the duty cycle, the red LED 102, green LED 104 and blue LED 106 will be driven to conduct a predetermined current stability. Therefore these LEDs are driven in a stable color temperature. In the present embodiment, the driving unit 10 will generate the driving currents correspondingly for driving the red LED 102 to emit red light, the green LED 104 to emit green light and the blue LED 106 to emit blue light and adapt the driving currents to conducting voltage of the red LED 102, green LED 104 and blue LED 106 respectively. These duty cycles preferably are synchronized to make the red LED 102, green LED 104 and blue LED 106 shiny alternately.

On the other hand, after the sensing unit 30 senses the light emitted by the light emitting devices, it will generate the intensity values correspondingly. The sensing unit 30 of the present embodiment is a wide-band sensor, for example. Thus, only one sensing unit 30 is sufficient for sensing light emitted by light emitting devices of various colors in a time-sharing way. For example, during a first duty cycle, the red LED 102 is driven to emit the red light. At this time, the sensing unit 30 will sense the illuminating intensity of the red light to get corresponding intensity values. However, during a second duty cycle, the green LED 104 may be driven to emit the green light, the sensing unit 30 will sense the illuminating intensity of the green light to get corresponding intensity values. With repeated operation, the sensing unit 30 can get the intensity values corresponding to the red LED 102, green LED 104 and blue LED 106 respectively, and transmit these sensed intensity values to the controlling unit 50 through the analog-to-digital converting unit 40.

Here, the analog-to-digital converting unit 40 is merely for format conversion, converting the intensity values of the analog format sensed by the sensing unit 30 to that of the digital format.

After the controlling unit 50 obtains the intensity values coming from the sensing unit 30, a plurality of pulse width correcting values can be calculated according to the intensity values and/or intensity reference value. These pulse width correcting values correspond to the red LED 102, green LED 104 and blue LED 106 respectively. The formula to calculate the pulse width correcting values is not limited but preferably associates to the efficiency to emit light of the individual red LED 102, green LED 104 and blue LED 106 and/or the aforesaid predetermined range of color temperature. The efficiency to emit light may be related to the aforesaid predetermined current and intensity values, and the predetermined range of color temperature may be related to the intensity reference values. Thus, after the controlling unit 50 performs the comparison and calculation for the intensity values and the intensity reference values, it will interpret the differences in the electrical characters of the pulse width correcting values, such as: voltage, current, frequency, amplitude and/or time, and transmit the pulse width correcting values to the pulse width adjusting unit 70.

Figure 2:
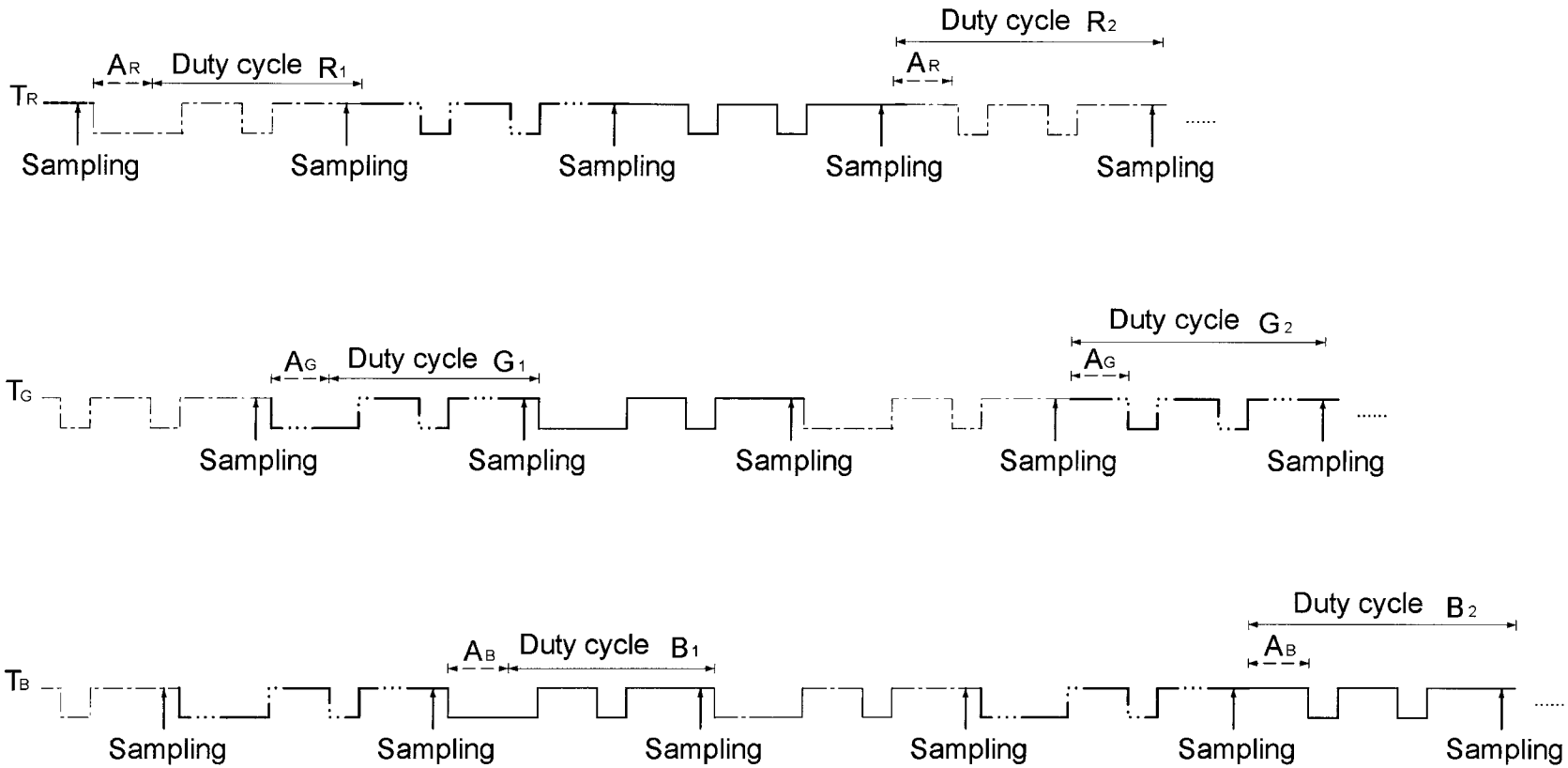
FIG. 2 illustrates a schematic diagram of timing signals of an embodiment according to one aspect of the present invention.

In order to understand the operation of the pulse width adjusting unit 70, please further refer to FIG. 2, which illustrates a schematic diagram of timing signals of an embodiment according to the present invention. When the pulse width adjusting unit 70 receives the pulse width correcting values from the controlling unit 50, it will adjust the pulse width of the high current (Pulse width) in the duty cycle of the driving currents of the corresponding red LED 102, green LED 104 and blue LED 106 according to the pulse width correcting values respectively. In the example drawn in FIG. 2, the detailed operation is as followed: in FIG. 2, the X axis represents time and the Y axis represents intensity. The electrical signals $T_R$, $T_G$ and $T_B$ correspond to the driving currents of the red LED 102, green LED 104 and blue LED 106, respectively. The marked description, duty cycle $R_1$, corresponds to the duty cycle of the red LED 102 when the duty cycle adjusting circuit 100 is activated. In other words, in the pulse width of the high current in the duty cycle R1, the red LED 102 will emit red light. Similarly, the descriptions of the duty cycle $G_1$ and duty cycle $B_1$, correspond to the duty cycle of the green LED 104 and blue LED 106, respectively, when the duty cycle adjusting circuit 100 is activated. When the red LED 102, green LED 104 and blue LED 106 conduct and emit light, such as the points marked by the sampling arrows in FIG. 2, the sensing unit 30 can sense the intensity values of the light emitted by the red LED 102, green LED 104 and blue LED 106 respectively.

For purposes of simplifying this description, here only take a few duty cycles for example to illustrate the operation of the pulse width adjusting unit 70. For the red LED 102, the pulse width adjusting unit 70 will modulate the pulse width of the high current near the rising edge $A_R$ to adjusts the electrical signal $T_R$ according to the pulse width correcting values calculated by the controlling unit 50, and preferably, the pulse width of the high current is proportionally increased to the pulse width correcting values. The example given here is to pull all low currents corresponding to where near the rising edge $A_R$ of the duty cycle $R_2$ up to increase the pulse width of the high current. Then the adjusted duty cycle $R_2$ is formed. However, it is not limited by the ratio or region shown here to adjust the pulse width of the high current, other ratio or region can be adjusted, for example, the pulse width near the falling edge of the duty cycle $R_2$ can be adjusted with other ratio. Preferably, the duty cycle of the light emitting devices can be adjusted to be greater than 60%, or even to 100%. Hence, because the red LED 102 will be driven to conduct and emit light in an increased interval, when the driving unit 10 is in the pulse width of the high current corresponding to the duty cycle $R_2$, the increased emitting interval of the red LED 102 will correspondingly increase the illuminating intensity of the red LED 102. This is similar to the green LED 104 and blue LED 106. After the adjustment for the red LED 102, green LED 104 and blue LED 106 respectively, the color temperature of the light emitted by the red LED 102, green LED 104 and blue LED 106 driven by the driving unit 10 emit is within above-mentioned predetermined range of color temperature.

Figure 3:
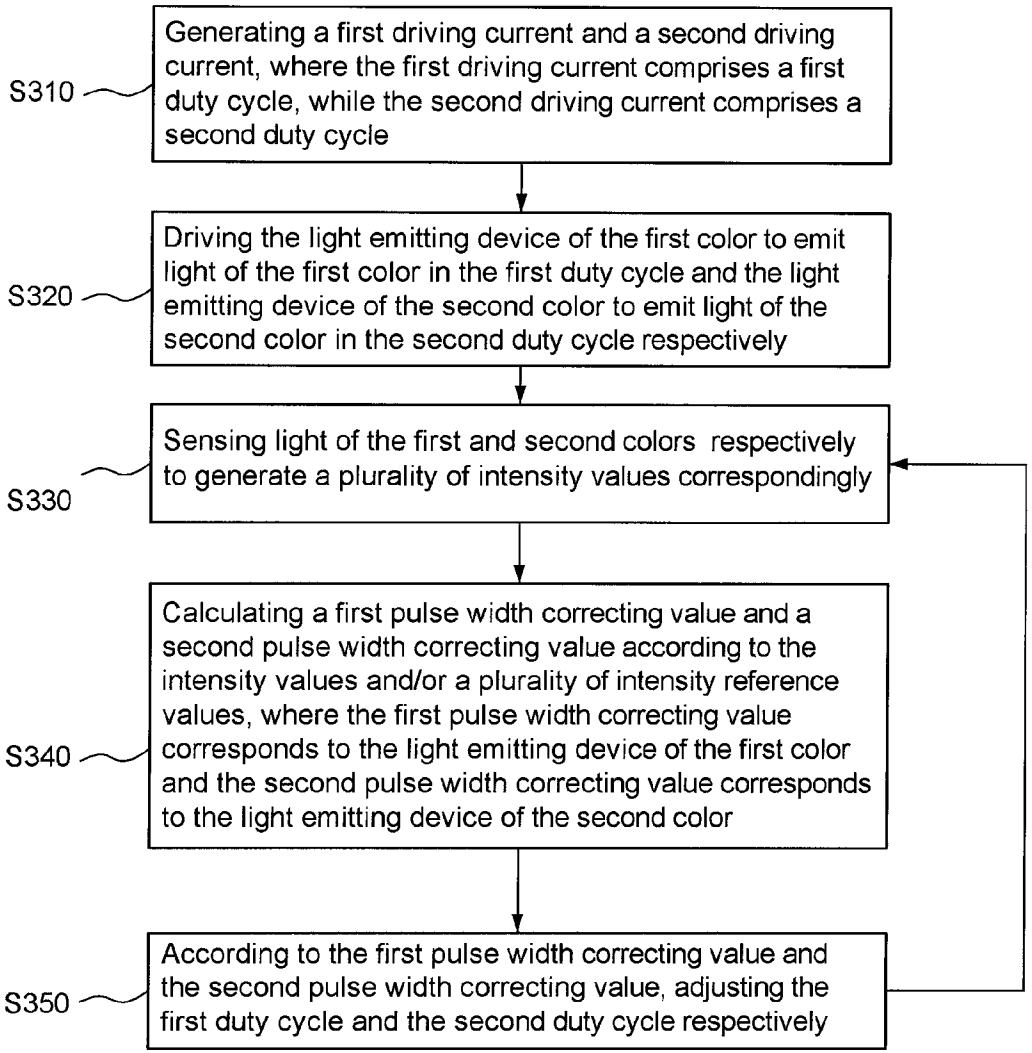
FIG. 3 illustrates a flow chart of the duty cycle adjusting method in an embodiment according to the present invention.

Please further refer to FIG. 3 which shows a flow chart of the duty cycle adjusting method in an embodiment according to the present invention. As shown, the duty cycle adjusting method comprises following steps. At first, the timing sampling unit generates a plurality of driving timings according to a plurality of reference timings for the driving unit to generate a first driving current and a second driving current. The first driving current comprises a first duty cycle, while the second driving current comprises a second duty cycle (step S310). However, when the driving unit is in the first duty cycle, the light emitting device of the first color will be driven to emit light of the first color, and when it is in the second duty cycle, light emitting device of the second color will be driven to emit light of the second color. Preferably, the light emitting device of the first color and the light emitting device of the second color will be driven to conduct a predetermined current to stabilize the color temperature in the first duty cycle and second duty cycle respectively (step S320). Later, through the at least one sensing unit, light of the first color and light of the second color are sensed respectively. The sensing unit will generate a plurality of corresponding intensity values to be provided to the controlling unit (step S330). After the controlling unit obtains these intensity values coming from the sensing unit, a first pulse width correcting value and a second pulse width correcting value will be calculated according to the intensity values and/or a plurality of intensity reference values. The first pulse width correcting value corresponds to the light emitting device of the first color and the second pulse width correcting value corresponds to the light emitting device of the second color (step S340). At this time, a further step can be comprised here to convert the format of the intensity values. For example, it may be converted from an original analog format to a digital format, and then a transmission occurs. Later, according to the first pulse width correcting value and the second pulse width correcting value, the pulse width adjusting unit adjusts the first duty cycle and the second duty cycle respectively (step S350). For example, the pulse width adjusting unit may increasingly adjust the pulse width of the high current in the first duty cycle or the second duty cycle to make it greater than 60%. As such, the light of the first color and the light of the second color will be within in a predetermined range of color temperature.

Therefore, after sensing the light of the first and second colors, the corresponding intensity values are generated for calculating the first pulse width correcting value and the second pulse width correcting value which forms the basis to adjust the first and second duty cycles to adjust the illuminating intensity of the light emitting devices of the first and second colors respectively. Preferably, by above-mentioned adjustment, the color temperature of the light of the first and second color is within in a predetermined range of color temperature, set or predetermined by users or manufacturers, to provide a stable light source with a stable color temperature.

Finally, those skilled in the art should appreciate that they can readily use the disclosed conception and specific embodiments as a basis for designing or modifying other structures for carrying out the same purpose of the present invention without departing from the spirit and scope of the present invention as defined by the appended claims.

What is claimed is:

1. A duty cycle adjusting circuit of a lighting system, adjusting illuminating intensity of at least one light emitting device of a first color and at least one light emitting device of a second color according to a plurality of intensity values respectively, comprising:

a driving unit, producing a first driving current and a second driving current wherein the first driving current comprises a first duty cycle, the second driving current comprises a second duty cycle, the driving unit drives the light emitting device of the first color to emit light of the first color in the first duty cycle, and the second duty cycle drives the light emitting device of the second color to emit light of the second color;

a sensing unit, respectively sensing the light of the first color and the light of the second color to produce the intensity values correspondingly;

a controlling unit, calculating a first pulse width correcting value and a second pulse width correcting value according to the intensity values, wherein the first pulse width correcting value corresponds to the light emitting device of the first color, the second pulse width correcting value corresponds to the light emitting device of the second color;

a pulse width adjusting unit, adjusting the first duty cycle and the second duty cycle according to the first pulse width correcting value and the second pulse width correcting value respectively; and a timing sampling unit providing the driving unit a plurality of driving timings for generating the first driving current and the second driving current, wherein the controlling unit controls the timing sampling unit according to a plurality of reference timings.

2. The duty cycle adjusting circuit of a lighting system as claim 1, wherein the pulse width adjusting unit increases the pulse width of the high current of the first duty cycle or the second duty cycle.

3. The duty cycle adjusting circuit of a lighting system as claim 1, wherein the pulse width adjusting unit adjusts the pulse width near the rising edge or the falling edge of the first duty cycle or the second duty cycle.

4. The duty cycle adjusting circuit of a lighting system as claim 1, wherein the driving unit drives the light emitting device of the first color to conduct a first predetermined current in the first duty cycle and the light emitting device of the second color to conduct a second predetermined current in the second duty cycle, which is asynchronous with the first duty cycle.

5. The duty cycle adjusting circuit of a lighting system as claim 1, wherein the light of the first color and the light of the second color are respectively within a predetermined range of color temperature, after the pulse width adjusting unit adjusts the first duty cycle and the second duty cycle according to the first pulse width correcting value and the second pulse width correcting value.

6. The duty cycle adjusting circuit of a lighting system as claim 1, wherein the controlling unit calculates the first pulse width correcting value and the second pulse width correcting value according to a plurality of intensity reference values.

7. The duty cycle adjusting circuit of a lighting system as claim 1, further comprising an analog-to-digital converting unit electrically connecting between the sensing unit and the controlling unit to convert the intensity values generated by the sensing unit to of a digital format for the controlling unit.

8. The duty cycle adjusting circuit of a lighting system as claim 2, wherein the duty cycle of the light emitting device of the first color or the light emitting device of the second color is greater than 60%.

* * * * *